US007364384B1

(12) United States Patent
Swistak

(10) Patent No.: US 7,364,384 B1
(45) Date of Patent: Apr. 29, 2008

(54) ANTI-ROTATION STOP FOR CHAMBER

(75) Inventor: Daniel J. Swistak, New Market, NH (US)

(73) Assignee: Infiltrator Systems, Inc., Old Saybrook, CT (US)

( * ) Notice: Subject to any disclaimer, the term of this patent is extended or adjusted under 35 U.S.C. 154(b) by 16 days.

(21) Appl. No.: 11/190,456

(22) Filed: Jul. 27, 2005

(51) Int. Cl.
*E02B 11/00* (2006.01)
*E02B 13/00* (2006.01)

(52) U.S. Cl. ..... 405/46; 405/43; 405/44; 405/45; 405/49

(58) Field of Classification Search ..... 405/49, 405/46, 36, 43, 44, 45
See application file for complete search history.

(56) References Cited

U.S. PATENT DOCUMENTS 5,017,041 A * 5/1991 Nichols ..... 405/48
5,087,151 A * 2/1992 DiTullio ..... 405/43
5,498,104 A * 3/1996 Gray ..... 405/43
5,556,231 A * 9/1996 Sidaway et al. ..... 405/48
6,592,293 B1 * 7/2003 Hedstrom et al. ..... 405/48
6,602,023 B2 * 8/2003 Crescenzi et al. ..... 405/42
6,612,777 B2 * 9/2003 Maestro ..... 405/49
6,698,975 B1 * 3/2004 Benecke ..... 405/43

* cited by examiner

*Primary Examiner*—Frederick L. Lagman
(74) *Attorney, Agent, or Firm*—C Nessler; S. McHugh

(57) ABSTRACT

A thermoplastic chamber for leaching wastewater or other use, which is designed so that when jointed to a like chamber the horizontal plane angle between the chambers can be adjusted, has one or more stops which can be selectively used to prevent rotation, for instance, to make the joined-together chambers lie along a straight line. Preferably, the stop is integral part of the chamber base flange; and it hinges and bends upwardly when moved to its working position, so the stop engages and limits movement of the end of the mating chamber.

19 Claims, 4 Drawing Sheets

ANTI-ROTATION STOP FOR CHAMBER

TECHNICAL FIELD

The present invention relates to molded plastic chambers used for receiving and dispersing water when buried in soil or other medium.

BACKGROUND

Molded thermoplastic arch shape cross section corrugated chambers are now well-known for different applications, including receiving wastewater and stormwater. The description here focuses on a chamber for the wastewater function. The chambers are typically connected end to end to form a chamber string within a trench beneath the surface of the earth, which is then backfilled with soil, crushed stone, or other medium. Wastewater flowing into the chambers exits the open bottom and passes through the perforated side walls into the surrounding water permeable medium. A string of such chambers is preferably installed in a straight line and with a very small down-slope, if any, from the inlet end to the other. A typical chamber of such type is shown in U.S. Pat. No. 5,336,017 to Nichols. Such early kind of chambers had only a small ability to rotate at the joint, of the order of 3 degrees plus or minus; and, that was accomplished by negating, or making inferior, the otherwise positive straight-fit joint. See U.S. Pat. No. 5,588,778 of Nichols et al.

However, sometimes the land contour or subsurface obstructions prevent the string from running in a straight line. Thus, in an approach used in recent years, chambers have joints which enable a chamber to be angled at a desired horizontal plane angle relative to an adjoining chamber, at the time of installation. Such chamber joints are in the trade said to permit rotation or swiveling, although once installed, the selection of angle between chambers is not subsequently changed, owing to the backfill. Commonly owned co-pending patent application Ser. No. 10/442,810 of Burnes et al., describes both a separate coupling for use with chambers, and chambers having integral rotation means. Quick 4™ leaching chambers sold commercially by Infiltrator Systems, Inc. of Old Saybrook, Connecticut have features like the chamber shown in the patent application. See also U.S. Pat. No. 6,592,293 to Hedstrom et al. Generally, in the aforementioned art, rotation of one chamber relative to the other is enabled by a surface of revolution at one chamber end, called the dome end here, which acts as a male pivot when overlapped by the opposing end of a like chamber.

When the aforementioned type of chamber is installed end-to-end, with the intent that the row of chambers runs in a straight line, the rotational adjustability of the joint is not wanted. If a string of chambers is constructed so it lies in a too-wide trench or open pit, then some guide is needed to help the installer runs along a straight line. Accomplishing that can be important when the distance between adjacent strings or rows of chambers is regulated and when the minimum inter-row spacing is desired. An installer may place guide strings, shine laser beams, or use other guide aids. That can slow the installer down and the result can be uneven, depending on the installer's ability and care. Thus, there is a need for a chamber joint which permits positive straight line connection when that is desired, and rotation or off-angle installation when that is desired.

SUMMARY

An object of the invention is to provide molded plastic chambers, for leaching wastewater and other purposes, which form joints that enable horizontal plane rotation for adjustable angling, along with means which aid an installer in making the chambers run along a straight line or in some other definite angular relationship. A further object is to provide chambers with anti-rotation stops which can be selectively moved by the installer, from a non-working position where the stop enables normal rotation of the chamber, to a working position, where the stop limits the angular rotation of the chamber.

The invention is applied to an arch shape cross section chamber which joins with a like second chamber to form a joint which is capable of permitting relative horizontal plane rotation of chambers. In accord with the invention, a chamber has at least one stop mounted at the end, to selectively engage a portion of the second co-joined chamber, according to the desires of the installer. When in its working position, the stop prevents horizontal plane rotation of the chambers in at least one rotational direction. Preferably, the stop is on the base flange of the chamber. Alternately, it may be located elsewhere on the end of the chamber.

In further accord with the invention, the stop is integral with chamber base flange, and projects upwardly or downwardly, to engage the outer end of a mating chamber, when the installer chooses to put the stop in working position. The stop has a first non-working position, wherein the stop lies in the plane of the flange, and a second working position, wherein the stop projects upwardly from the plane of the flange. Thus, the stop is referred to as a "pop up stop". The stop may be lowered, if during installation, it is found the anti-rotation feature is not wanted. In this and other embodiments, only one stop may be used, in which case the installer biases the rotation of the second chamber against the stop during installation. Preferably, two pop-up stops are used, one on each side of the chamber, so any rotation is prevented.

In one pop-up stop embodiment, the stop comprises a cantilever tab having a first end which is attached to the base flange. The stop body bends upwardly relative to the base flange, when put into its working position. The free end of the stop mechanically engages with a retaining feature in the flange, for instance opposing side slots, so it is held in place. In an example, the stop body has a flat cross shape and comprises at least one living hinge at the base of the upright of the cross shape. Preferably there is also a second living hinge along the length of the body. The stop bends about the living hinge(s) and is held in position by resilient engagement of the cross arm with indents or slots in the base flange. Preferably, a chamber of has two stops, each stop preventing motion of said second chamber in a different rotational direction; and the stops cause the chambers to lie along a straight line (or other predetermined angle).

In other chamber embodiments, the stop is a separate element which fits in a hole or otherwise attaches to the base flange, or to another part of the end of the second chamber, such as a dome portion. The stop limits motion of the second chamber by contacting its outer edge, as do the pop-up stops, or alternately, by engaging a hole or other feature in the end of the second chamber.

The foregoing and other objects, features and advantages of the present invention will become more apparent from the following description of preferred embodiments and accompanying drawings.

DESCRIPTION

Figure 1:
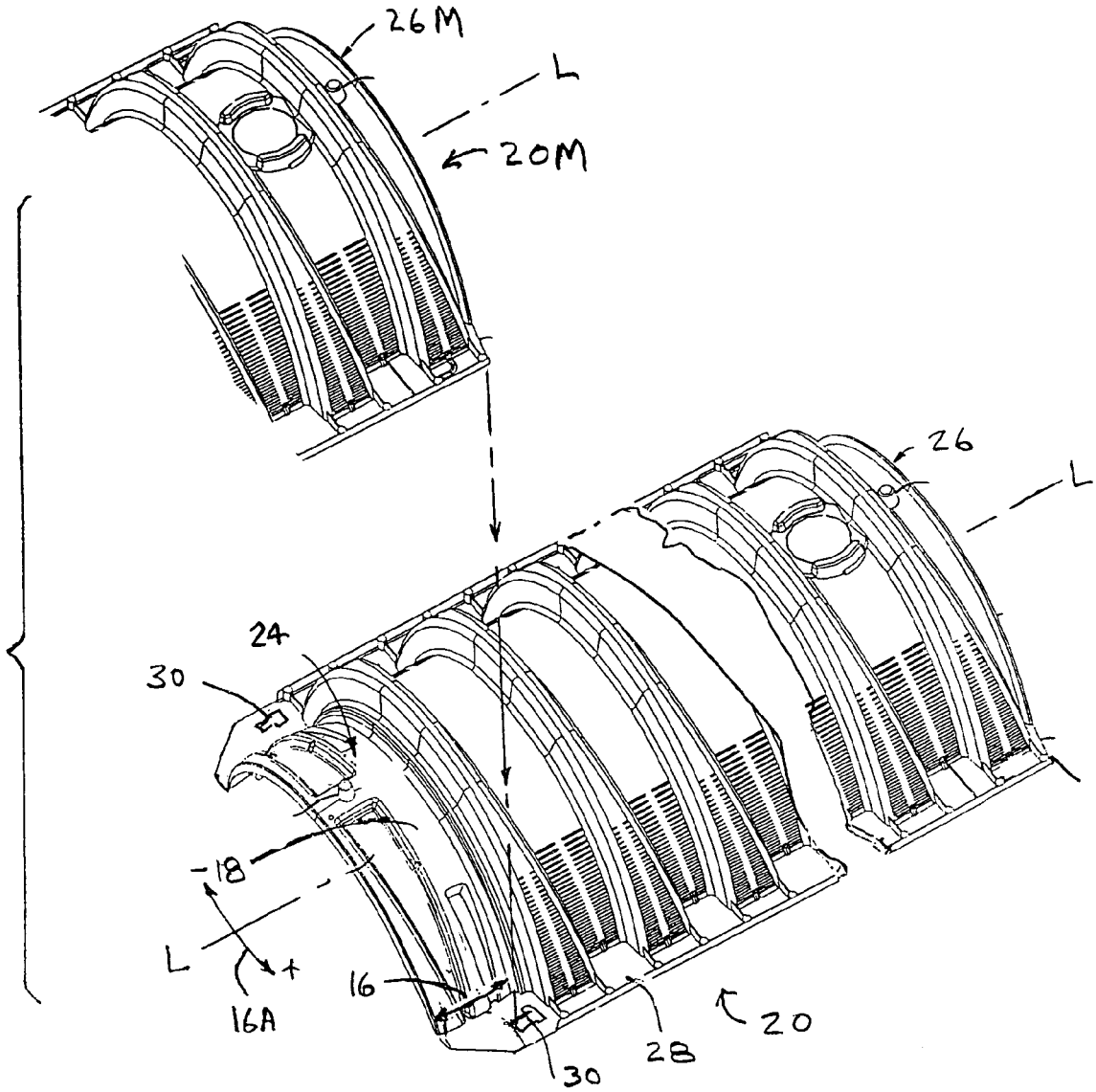
FIG. 1 shows a leaching chamber and how its dome end is overlapped by the opposing end of an identical chamber, shown as a fragment. The chamber has opposing side pop-up stops in their non-working position.

In the present invention, the solution to the need described in the Background comprises providing one or more stops on a chamber, the design of which enables it to form a rotationally adjustable joint with another like chamber. The stops preferably are integral with the chamber and pop into place by simple manipulation of the installer. For example, FIG. 1 shows in isometric fashion a typical molded thermoplastic chamber 20, much like an Infiltrator® Quick4™ leaching chamber. That preferred kind of chamber, with which the invention is particularly useful, is described in commonly owned co-pending application Ser. No. 10/442,810 (filed May 20, 2003) of Burnes et al., especially in connection with FIG. 13, and in co-pending application Ser. No. 10/677,938 (filed Oct. 1, 2003) of Brochu et al., the disclosures of which are hereby incorporated by reference. The chamber is arch shape in cross section and has corrugations running along the arch curve. The end 24 of chamber 20 has a surface of revolution portion, referred to here as dome 18. In use, the male end 24 of the chamber is overlapped by the opposing female end 26M of an identical chamber 20M, as the exploded view of FIG. 1 represents. The joint so formed between the chambers permits horizontal plane rotational motion as indicated on the dome by the arrows 16 and 16A. Motion about the chamber longitudinal axes L is arbitrarily defined as positive (+) or negative (−) at arrow 16A.

In one embodiment of the invention, chamber 20 has opposing side stops 30 which are integral with the opposing side base flanges 28; and, prior to use, the stops lie flat in the plane of the flanges, as shown in FIG. 1. When the installer desires that the longitudinal axes L of the chambers be aligned or parallel, the installer moves the stops to their working positions by "popping them up" from the plane of the flanges, as described below. The stops are located on the flange so that the outer edge of the end 26M of the overlying chamber contacts them to prevent plus or minus rotation, and the chambers 20M and 20 are thus forced to align end-to-end.

Figure 2:
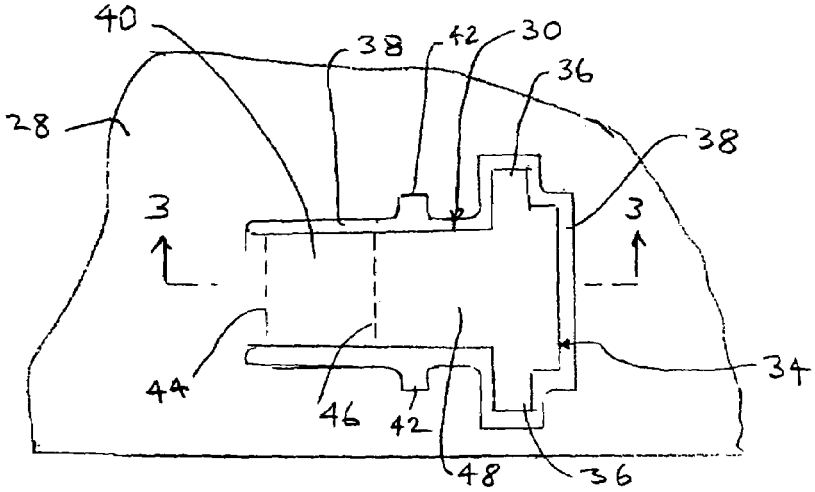
FIG. 2 is a top view of a pop-up stop, shown on the base of the chamber of FIG. 1, where the stop has two living hinges and is in its original as-made, or non-working, position.
Figure 3:
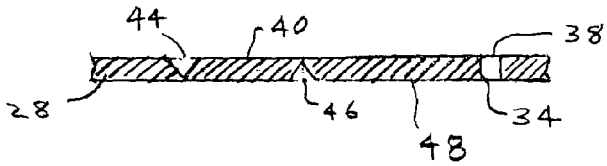
FIG. 3 is a cross section through the stop and adjacent flange, shown in FIG. 2.
Figure 4:
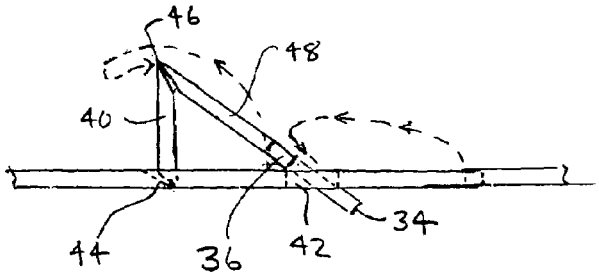
FIG. 4 is side view of the flange portion and stop shown in FIG. 2, where the stop is in its popped-up or working position. The arrows show the movement of the stop, from its non-working or original position.

FIG. 2 is a more detail planar view of stop 30 shown in FIG. 1, and portion of the flange, with the stop in the position it has at the time of manufacture and during shipment of the chamber. That position is called the non-working position, or the original position. FIG. 3 is a vertical elevation centerline cross section of the stop in the non-working position. FIG. 4 is a side elevation view of the flange with the stop in its working position, with arrows which show the motion of certain parts of the stop as it moves from its non-working position to its working position.

FIG. 2 shows stop 30 has the shape of a Latin cross in it original position. It has an "upright" which is called here the body of the cross, which is comprised of portions 40, 48 and 38. The lower portion 40 of the body is the only part which is permanently attached to the base flange. A cross arm which has opposing side projecting stubs 36 conceptually crosses the middle body portion 48. The upper portion 38 of the body, above the cross arm 36, is stubby and wider than the middle and lower portions of the body. The stop 30 comprises two so-called living hinges, 44, 46, which are thinned linear portions of the ductile plastic of the chamber/stop, about which the stop body can fold. See FIG. 3. Hinge 46 connects the lower and middle portions of the body; hinge 44 connects the lower body portion of the stop to the flange 28.

Channel 38 runs around the periphery of the stop, except where it attaches to the flange at living hinge 44. The channel follows the outline of the stop, except for the addition of two opposing side indents 42, which are nearer to the hinge 44 than is the cross arm. If desired, one or more easily severed ligaments, or an extremely thin web all around, may run across the channel 38 to ensure the stop stays in place during handling of the chamber.

With reference to FIGS. 3 and 4, the stop is placed in its working position as follows: The whole stop is first bent upwardly about hinge 44. Then middle body 48 is bent downwardly about hinge 46, relative to the just-raised up lower portion 40. In doing that, the opposing side outer arms 36 are made to touch, and then are slid along the top of the flange surface, until the top 34 of the stop drops through the opening provided by the opposing side indents 42 of the channel 38. When that occurs, arms 36 are brought into contact with the top surface of the flange, preventing further downward motion of the top 34. At the same time, the outer edges of top 34 engage the edges of indents 42, and prevent any horizontal motion of the top away from the hinge 44 location. As shown in FIG. 4, the stop bottom portion 40 is thus made nominally vertical, and the main body 48 is an inclined ramp which supports the bottom portion 40 in its nominally vertical position. The resilience of the plastic at the living hinges joints urges the body to the right in the Figure, and thus keeps the top and arms engaged with the retaining feature portions of the flange which they contact. If desired the stop can be restored to its original position by overcoming the resilient force and reversing the motions just described.

As can be discerned from FIG. 4, and the motion-arrows, during the process of putting the stop in working position, the base 40 moves to and beyond vertical, and then back to substantially vertical. Thus, the V-grooves of the hinges 44, 46 provide appropriate clearance or relief for that motion. Nubs and other surface features may be placed on the surface of the stop, to make easier the grasping of the stop in the field.

Preferably, there are two stops 30, one on either of the opposing side base flanges 28 of the chamber. See FIG. 1. Thus, each stop prevents motion of a mating chamber 20M in the positive and negative direction, respectively, and the mating chamber axis L is forced into straight alignment with the first chamber axis L. Alternately, with this and other embodiments, only one stop which engages an outer edge of the mating chamber can be effective. The installer can bias the overlying chamber against the one stop, and rely on friction, rather than a second stop, to keep the chamber from moving away from the stop.

Figure 5:
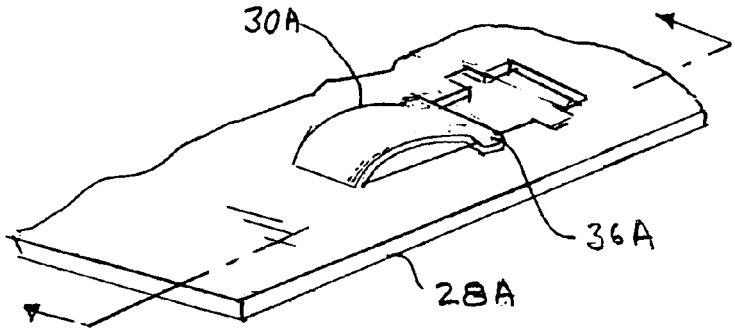
FIG. 5 is an isometric view of a flange of a chamber showing an alternative embodiment pop-up stop in its working position, like the stop in FIG. 4.
Figure 6:
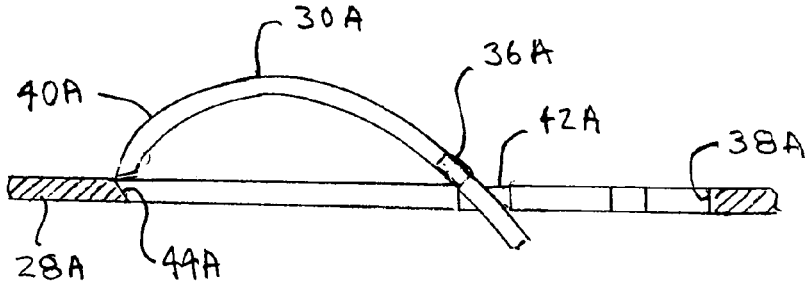
FIG. 6 is a partial cross section view of the stop of FIG. 5.

The stop may be configured differently from preferred stop 30. In the following embodiments, parts which correspond with the parts described above have similar numbers with suffixes. FIG. 5 and FIG. 6 show stop 30A which has only one living hinge 44A. When the stop is moved into working position, it bends to a curve, as shown. While the surface 40A which is thus presented to contact the outer edge of a mating chamber will not be vertical, it still can be sufficient for the desired purpose.

In a variation applicable to both stops 30 and 30A, instead of using engagement of the top and cross arm with indents 42, 42A, other mechanical arrangements may be used to secure the top end of the stop in place on the flange. For instance, sheet metal screws may be used to attach the cross arms to the flange adjacent the channel, in the absence of the indents. Other than cross shape stops may be used to carry out the generality of the invention, wherein a stop molded in the plane of the flange is manipulated to project upwardly or downwardly from the flange and engage a feature on a mating chamber.

Figure 7:
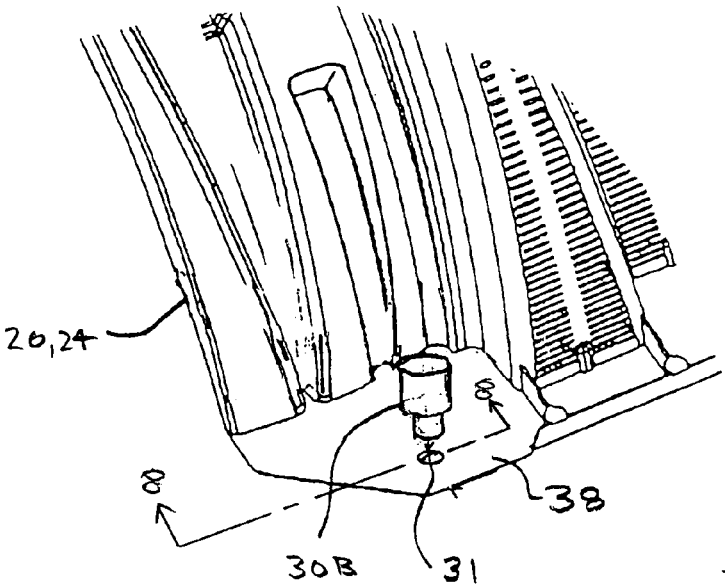
FIG. 7 is an isometric view of a separate-element stop showing how it inserts into a hole in the flange of a chamber.
Figure 8:
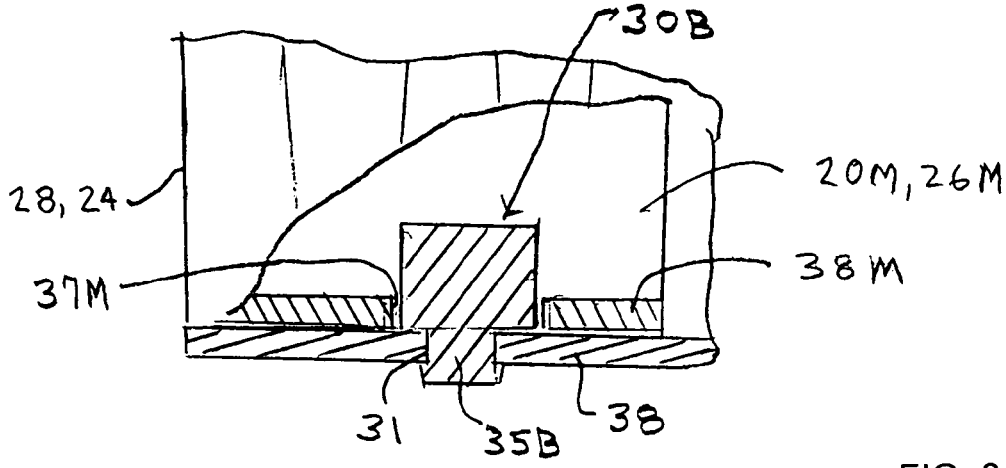
FIG. 8 is a vertical cross section, showing the stop of FIG. 7, along with a base fragment of a second chamber which is overlapped on the end of the first chamber to form a joint. The stop is engaged with a hole in the second chamber.

The advantage of having the stop as part of the flange in the chamber, as just described, is that the stop will always be readily available to the installer, and he need not seek separate parts, which may not be handy. If, after raising the stops, the installer decides that off-straight line alignment is appropriate, the stops 30, 30A may be lowered to about their original position. Nonetheless, in the generality of the invention, the stop may be a separate element. For example, FIG. 7 and FIG. 8 show stop 30B comprises a cylindrical body, alternately any other shape, with a smaller diameter pin base 35B, which the installer places into hole 31 in the flange. As suggested by FIG. 8, the base 35B of the stop may have a mushroom head, which stops it from popping out of the hole. Stop 30B may be positioned in the way described for stop 30, namely so the outer edge of the end of the mating chamber contacts the side of the stop. Alternately, FIG. 8 illustrates how stop 30B may be positioned so that it engages a hole 37M which is provided in the flange 38M of the overlying chamber (shown fragmentarily and in axial cross section running through the center of the stop). The one stop thus prevents rotary motion in both the positive and negative directions. Only one stop, or two stops, may be used in the FIGS. 7 and 8 embodiments.

Figure 9:
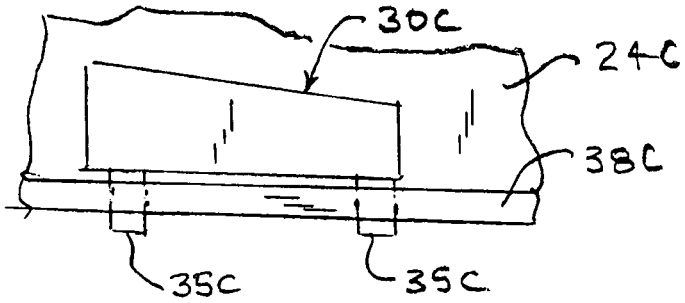
FIG. 9 shows a stop functionally similar to the stop shown in FIG. 7, where the stop has two pins inserted into the flange.
Figure 10:
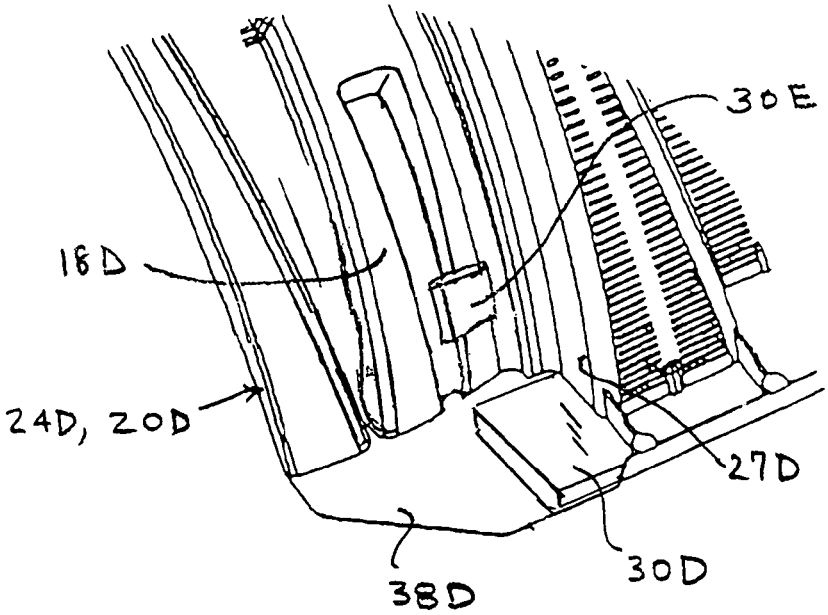
FIG. 10 shows a chamber having a first flat plate stop which rests on the base flange of the chamber, and a second stop which mounts on the dome of the end of the chamber.

FIG. 9 shows another separately formed stop 30C, having two pin projections 35C which fit into holes in the flange. The stop 30C will function similarly to the stop 30B. In another alternative, a stop may be attached to the flange at a pre-marked location by means of one or more screws or other fasteners. In another embodiment, shown in FIG. 10, stop 30D is a flat plate which lies on the top of flange 38D of chamber 20D, in unfastened condition, so it butts against the outer edge 27D of the first corrugation at the end 24D of the chamber. FIG. 10 also serves to show conceptually how a stop may alternately be located elsewhere than on the flange. Stop 30E is mounted on the dome 18D; it is intended for use without stop 30D and vice versa. Stop 30E can have one of the configurations previously described, although using the pop-up style of FIG. 1 or the pin-through-hole configuration of FIG. 7, for instance, would have to be done with caution, to avoid upsetting the functionality of dome in chamber joints where stops are not used. In still another embodiment, not shown, the stop may mount attach to the surface of the first corrugation, e.g., on surface 27D. In still another embodiment, the stops described can be mounted on the underside of the flange of overlying chamber, so they project downwardly or inwardly, to engage the end or another feature of the underlying chamber.

While the description above is focused on stops which align mating chamber axes along a straight line, stops can located otherwise, to define other than straight line joints, within the range of motion permitted by the joint.

The chambers of the present invention are preferably made by injection molding, alternately by thermoforming or other known means. Preferably, they are made of thermoplastics such as polypropylene or high density polyethylene. The invention is useful for chambers mentioned in the Background, and can be used for chambers which enable rotation at the joint by means other than a dome end, for instance the chamber described in Zoeller et al. U.S. Pat. No. 6,375,388. The invention is also useful for other types of chambers which are similar to the chambers of the preferred embodiments, for instance, to chambers which are used for receiving and dispersing storm waters, which are familiar for use in connection with shopping center automobile parking lots and other paved areas. They are often buried in crushed stone medium beneath the paved areas.

Of, course the integral, or living hinge type, stop my find use in other molded plastic articles where a means for selectively providing a limit on motion is desired. For instance, the stop can be employed to limit linear motion, for instance of a drawer, or of a hollow shaft within a sleeve.

Although this invention has been shown and described with respect to a preferred embodiment, it will be understood by those skilled in this art that various changes in form and detail thereof may be made without departing from the spirit and scope of the claimed invention.

I claim:

1. In a chamber for receiving and dispersing water when buried within porous medium, the chamber being made of molded plastic and having an arch shape cross section and opposing side base flanges, wherein the chamber joins with a like second chamber to form a joint, an improvement which comprises:

at least one configurable anti-rotation stop, mounted at the end of one of the chambers, for selectively engaging a portion of said second chamber, to prevent horizontal plane rotation of the chambers in at least one rotational direction.

2. The chamber of claim 1 wherein the stop is configurable to projects upwardly from a base flange of the chamber.

3. The chamber of claim 2 wherein the stop limits rotation of the second chamber in a way which enables the longitudinal axes of the joined-together chambers to lie substantially along a straight line.

4. The chamber of claim 2 wherein the stop engages a hole in the flange of the second chamber.

5. The chamber of claim 2 wherein the stop has projections which engage perforations in the base flange of the first chamber.

6. The chamber of claim 2 wherein the chamber comprises a dome for receiving the opposing end of the like chamber, and wherein the stop is mounted on a surface of revolution.

7. The chamber of claim 2 wherein the stop is configurable to be essentially flush with the base flange of the chamber.

8. The chamber of claim 1 wherein the chamber has two stops, each stop preventing motion of said second chamber in a different rotational direction.

9. The chamber of claim 1 wherein the stop limits rotation of the second chamber in a way which enables the longitudinal axes of the joined-together chambers to lie substantially along a straight line.

10. The chamber of claim 1 wherein the stop is a separate element, mechanically attached to the base flange.

11. The chamber of claim 1 wherein the first chamber comprises a dome for receiving the opposing end of the like chamber, and wherein the stop is mounted on the base flange adjacent to the dome.

12. In a chamber for receiving and dispersing water when buried within porous medium, made of molded plastic and having an arch shape cross section and opposing side base flanges, wherein the chamber joins with a like second chamber to form a joint, the improvement which comprises: at least one stop, mounted at the end of one of the chambers, for selectively engaging a portion of said second chamber, to prevent horizontal plane rotation of the chambers in at least one rotational direction, wherein said stop projects upwardly from a base flange of the chamber and wherein the top is an integral part of a base flange, the stop having a first non-working position, wherein the stop lies in the plane of the flange, and a second working position, wherein the stop projects upwardly from the plane of the flange.

13. The method of claim 12 wherein the stop is a cantilever tab having a first end which is attached to the base flange and upwardly bendable relative to the base flange; and a second free end, which when the tab is bent upwardly, resiliently engages with a retaining feature in the flange.

14. The chamber of claim 13 wherein the stop tab in its non-working position has a cross shape and is surrounded by channel having indents, the stop comprising at least one living hinge at the base of the upright of the cross shape; wherein the indents comprise said retaining feature.

15. The chamber of claim 14 wherein the stop has a second living hinge, spaced apart along the upright of the cross shape; and, wherein the stop in its working position has a portion which is nominally vertical, for contacting the edge of the base flange of the second chamber.

16. The chamber of claim 12 wherein the chamber has two stops, one on each opposing side base flange, each stop preventing motion of said second chamber in only one rotational direction.

17. The chamber of claim 12 wherein said stop prevents motion of the second chamber in both rotational directions.

18. A chamber for receiving and dispersing water when buried within porous medium, made of molded plastic, comprising:

a corrugated arch shape cross section and opposing side base flanges, the chamber having a dome end, which when overlapped by the opposing end of a second chamber forms a joint between the chambers which permits relative horizontal plane rotation of the chamber; and two configurable anti-rotation stops, one each mounted on an opposing side base flange proximate the dome end, each stop having a first non-working position, wherein the stop lies in the plane of the flange, and a second working position, wherein the stop projects upwardly from the plane of the flange and engages the end of a second chamber overlapping the dome end, for preventing horizontal plane rotation of the chambers.

19. The chamber of claim 18, wherein each stop has a cantilever body connected to the base flange by a first living hinge, together with a second living hinge along the length of the body, so that when the stop projects upwardly, the stop body bends about the living hinges to provide a nominally vertical portion which engages the end of the second chamber.

* * * * *